US008882573B2

(12) United States Patent
Barfield et al.

(10) Patent No.: US 8,882,573 B2
(45) Date of Patent: Nov. 11, 2014

(54) CEILING AIR DEFLECTOR INSERT AND METHOD OF ASSEMBLY

(75) Inventors: John W. Barfield, Ann Arbor, MI (US); Jingqiu Mei, Northville, MI (US)

(73) Assignee: T.C. AirTech, Inc., Northville, MI (US)

( * ) Notice: Subject to any disclaimer, the term of this patent is extended or adjusted under 35 U.S.C. 154(b) by 1756 days.

(21) Appl. No.: 11/909,845

(22) PCT Filed: Mar. 31, 2006

(86) PCT No.: PCT/US2006/011717

§ 371 (c)(1), (2), (4) Date: Sep. 27, 2007

(87) PCT Pub. No.: WO2006/105328

PCT Pub. Date: Oct. 5, 2006

(65) Prior Publication Data

US 2009/0124190 A1 May 14, 2009

Related U.S. Application Data

(60) Provisional application No. 60/666,960, filed on Mar. 31, 2005.

(51) Int. Cl.

| | |
|---|---|
| ***F24F 7/00*** | (2006.01) |
| ***F24F 13/068*** | (2006.01) |
| *F24F 13/08* | (2006.01) |

(52) U.S. Cl.

CPC ..... *F24F 13/068* (2013.01); *F24F 13/084* (2013.01)

USPC ..... 454/292; 454/248; 454/306; 454/309

(58) Field of Classification Search

USPC ..... 52/22, 109, 264, 200, 588.1, 506.7, 39, 52/712, 506.1, 483.1, 489.1; 29/700; 454/292, 248, 299, 306, 309; 95/273

See application file for complete search history.

(56) References Cited

U.S. PATENT DOCUMENTS

| | | | | |
|---|---|---|---|---|
| 3,802,131 | A * | 4/1974 | Resech | 52/60 |
| 4,655,120 | A * | 4/1987 | Lemmo | 454/292 |
| 4,693,174 | A | 9/1987 | Anderson | |
| 5,016,406 | A | 5/1991 | Calam et al. | |
| 5,046,405 | A | 9/1991 | Roy | |
| 5,141,473 | A | 8/1992 | Swaney | |
| 5,326,187 | A * | 7/1994 | St. Marie et al. | 52/717.05 |
| 5,411,438 | A * | 5/1995 | White et al. | 454/300 |
| 6,050,015 | A * | 4/2000 | Lurie | 52/645 |
| 6,067,759 | A | 5/2000 | House | |
| 6,341,466 | B1 * | 1/2002 | Kehoe et al. | 52/712 |
| 6,477,816 | B1 | 11/2002 | Di Biase | |
| 6,745,518 | B2 | 6/2004 | Weakes et al. | |

OTHER PUBLICATIONS

International Search Report dated May 31, 2006 including Written Opinion of the International Searching Authority mailed Jul. 20, 2006.

* cited by examiner

*Primary Examiner* — Henry Yuen
*Assistant Examiner* — Hung D Nguyen
(74) *Attorney, Agent, or Firm* — Renner, Otto, Boisselle & Sklar, LLP

(57) ABSTRACT

A square deflector insert for a drop ceiling made of four identical sides that can be simply field assembled and installed. In contrast to previous single-piece inserts, the new inserts provide much more compact packaging for shipping but can be assembled quickly just before installation. Although described in terms of a square deflector the invention is applicable to other polygonal shapes.

8 Claims, 3 Drawing Sheets

CEILING AIR DEFLECTOR INSERT AND METHOD OF ASSEMBLY

BACKGROUND OF THE INVENTION

The field of the invention pertains to ceiling air deflectors used primarily for forced air heating and ventilating systems in commercial structures, such as large retail stores. In particular, the invention pertains to air deflectors that fit in a modular manner into square or rectangular grid suspended ceilings.

A particular example of such an air deflector is illustrated in U.S. Pat. No. 6,745,518 wherein an air deflector is positioned in a standard 2-foot by 2-foot grid suspended ceiling. This patent is directed to an add-on air deflector insert to solve a problem that has arisen from the air deflectors.

Eventually, the air flow from air deflectors deposits dirt, soot and other particulates on the ceiling (usually white) around the air deflector. The result is an unsightly dirty area about the air deflector that is difficult to clean and usually must be re-painted. The air deflector insert of the above patent comprises a single-piece square fin that extends downwardly from the grid and surrounds the air deflector. The square fin deflects air moving from the air deflector away from the ceiling immediately surrounding the air deflector, thereby diminishing the accumulation of particulates on the ceiling over time.

With a view to further improving the deflector insert, the applicant has developed the following improvements.

SUMMARY OF THE INVENTION

The air deflector insert of the above patent is a single integral frame which requires considerable bulk to package and ship for its actual weight. In contrast, by manufacturing four separate identical component pieces, the package size can be greatly reduced, or six or more inserts can be packaged in the same size package as a single-piece insert. Disclosed below are examples of corner connections applicable to the four separate identical pieces that permit the air deflector insert to be assembled in less than a minute, on-site, just before installation.

DESCRIPTION OF THE PREFERRED EMBODIMENT

Figure 1:
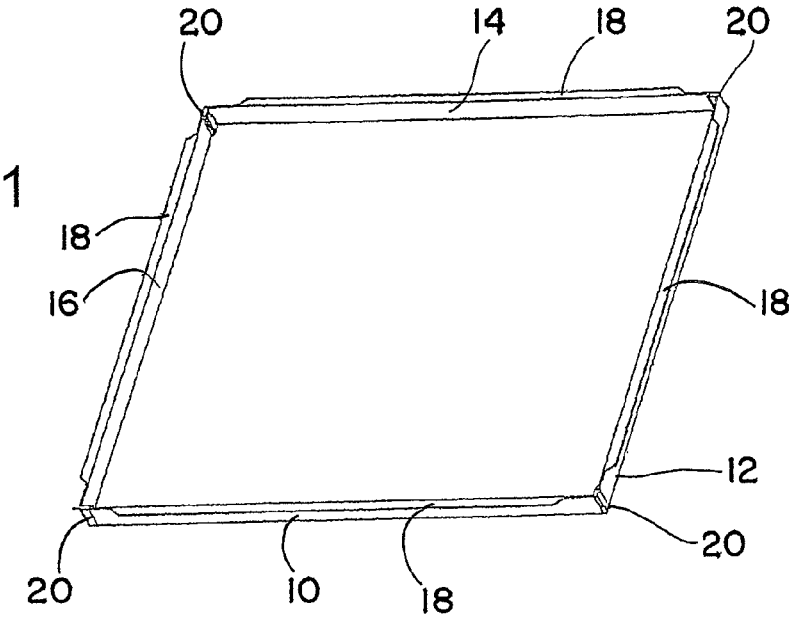
FIG. 1 illustrates in perspective a ceiling air deflector insert.
Figure 2:
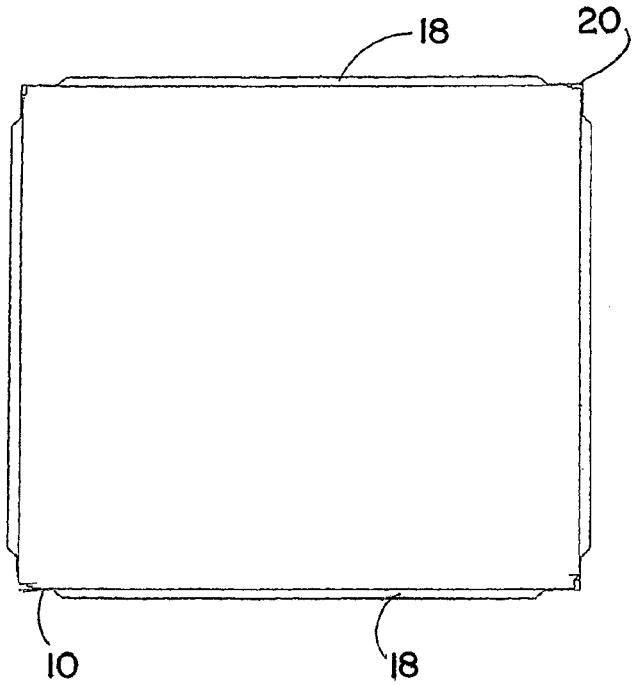
FIG. 2 shows a ceiling air deflector insert in plan view.
Figure 3:
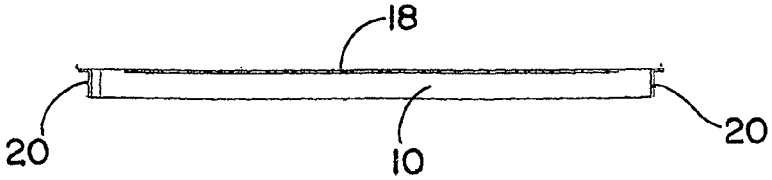
FIG. 3 is a side view of a ceiling air deflector.

Illustrated in FIGS. 1, 2 and 3 is a fully assembled air deflector insert having four side pieces 10, 12, 14 and 16 that are identical to form a square shape. Each side piece 10 to 16 extends downwardly from a separate flange 18, the flange being adapted to rest on the 2'×2' grid members of a typical suspended or drop ceiling in common use in commercial structures. Other sizes and shapes of air deflectors are in use or can be envisioned, therefore other sizes and shapes to encircle the air deflector with an air deflector insert can be envisioned.

Figure 6:
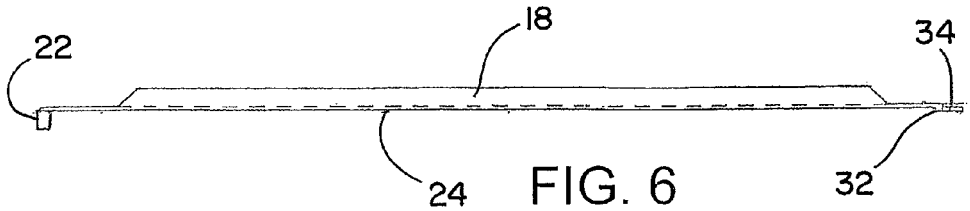
FIG. 6 is a plan view of the side piece of FIG. 4
Figure 4:
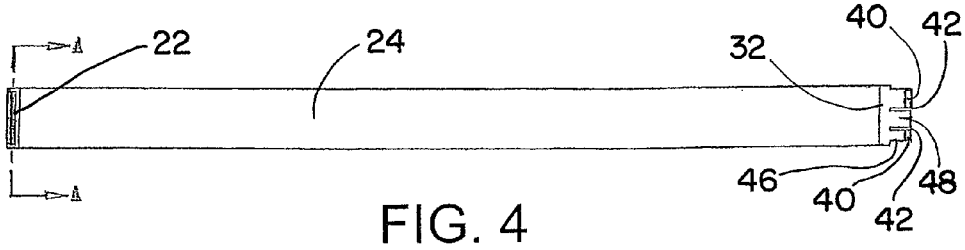
FIG. 4 is an inside elevation of a single side piece.
Figure 5:
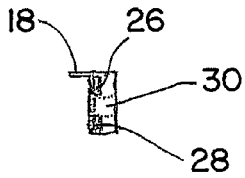
FIG. 5 is a cross-section taken along the line A-A in FIG. 4 showing the attachment means.

At one end of each side piece 10 to 16 are attachment means 20, such as the rectangular socket 22 extending perpendicularly from the side 24 as shown in FIGS. 4 and 6 to the left. In the detail of FIG. 5 the socket 22 includes a latching feature comprising upper 26 and lower 28 openings in the inside 30 of the socket.

Figure 7:
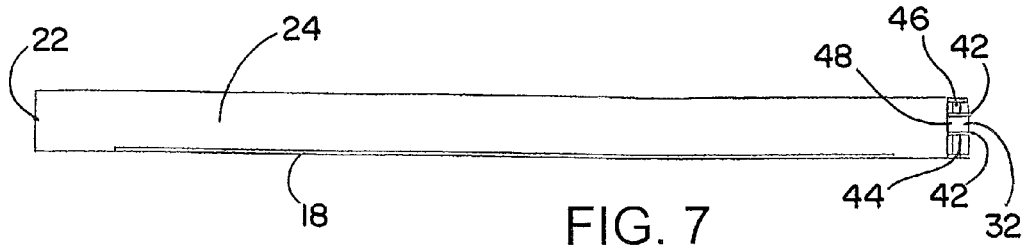
FIG. 7 is an outside elevation of the side piece of FIG. 4, the side piece having been rotated 180° from the view in FIG. 4.
Figure 8:
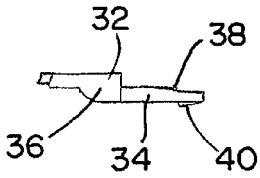
FIG. 8 is a detail of the complementary attachment means at the opposite end of the side piece from the attachment means shown in FIG. 5.

At the other end of each side piece 10 to 16 are complementary attachment means 32 such as the tongue 34 extending from the side 24 as shown to the right in FIGS. 4, 6 and 7. The tongue 34 extends generally parallel to the side 24 but offset 36 as best shown in FIG. 8. The tongue 34 is slightly tapered 3S on one side and formed with a cusp 40 on the other side.

The tongue 34 is split by slots 42 forming an upper tongue 44, lower tongue 46 and middle tongue 48. The upper tongue 44 is sized vertically with its cusp 40 to match the upper opening 26 in the socket 22. Likewise, the lower tongue 46 with its cusp 40 is sized vertically to match the lower opening 28 in the socket 22. Upon insertion of the tongue 34 of one side piece into the socket 22 of another side piece properly, the cusps match the openings 26 and 28 and the attachment snaps together to permanently latch the side pieces together.

If one of the side pieces is misoriented relative to the other side piece, both tongues 44 and 46 will be misaligned to the upper and lower openings 26 and 28 and not properly snap together.

Figure 9:
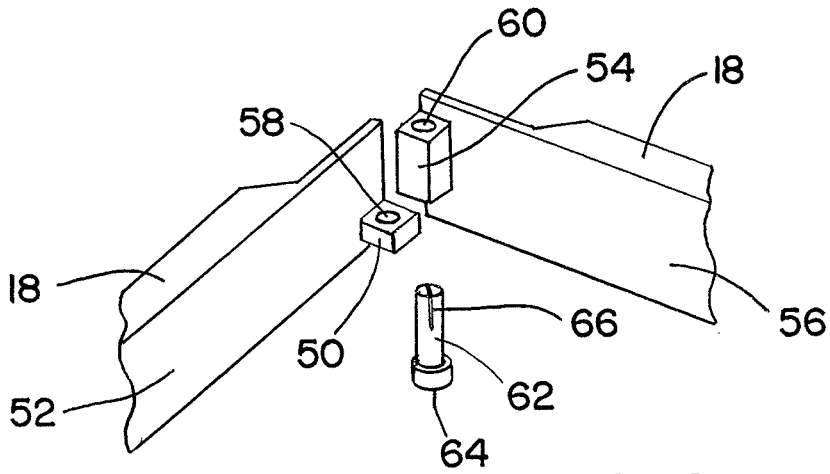
FIG. 9 illustrates in perspective an alternative attachment between two side pieces.

In FIG. 9 an alternative form of the attachment means comprises a protrusion 50 from the inside sidewall 52 and a complementary protrusion 54 from a next adjacent inside sidewall 56. Each protrusion may be integral with its respective sidewall or separately attached thereto. The protrusions 50 and 54 are pierced by holes 58 and 60 respectively. When the attachment means is brought together, the holes 55 and 60 are in axial alignment and a pin 62 can be inserted therethrough to join the sidewalls 52 and 56 together. Pin 62 is headed 64 as shown and has an interference fit with hole 60 to permanently join the sidewalls together. The pin 62 may be forked 66 to aid in inserting the pin with an interference fit.

Figure 10:
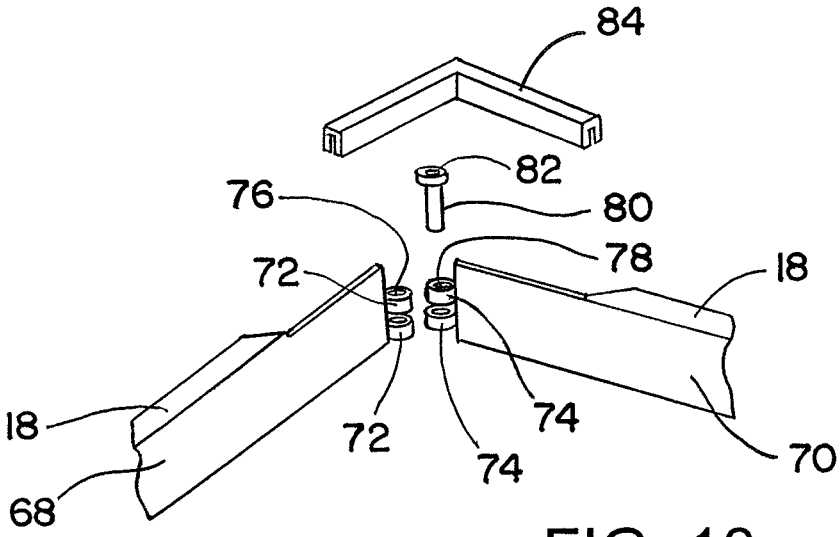
FIG. 10 illustrates in perspective a second alternative attachment between two side pieces.

FIG. 10 illustrates another pinned attachment means. Each sidewall 68 and 70 includes a pair of protrusions 72 and 74 which complementarily nest together as shown. The protrusions 72 and 74 are pierced by holes 76 and 78 respectively that axially align when the attachment means is joined together by a pin 80. The pin 80 is headed 82 and locked in place by a corner bracket 84 which fits over the sidewall 68 and 70 edges adjacent the corner and attachment means. The corner bracket 84 may provide for an interference fit with the sidewalls or be adhesively attached for a permanent assembly of the attachment means.

The invention claimed is:

1. An air deflector insert mountable and suspendable downwardly in an opening formed by grid members in a suspended grid ceiling, said insert comprising four separate side pieces, each side piece having a downwardly extending air deflecting portion and an integral generally horizontally extending means adapted to at least partially support the side piece on an adjacent grid member, each side piece having attachment means at one end and complementary attachment means at the other end whereby the four sides can be permanently joined at four corners by hand manipulation, with the attachment means being manually connected to next adjoining side complementary attachment means, and wherein at least one of the attachment means includes at least one tongue on a first one of the side pieces and the complementary attachment means includes a socket on a second one of the side pieces, which socket snaps together with the tongue to join the first one and second one of the side pieces, and wherein the socket extends outwardly and perpendicular to the second one of the side pieces, and wherein the at least one tongue includes a plurality of tongues separated by slots, wherein said plurality of tongues includes said one tongue and a second tongue on opposite sides of a central tongue, said one tongue and said second tongue including latching cusps, and the socket has respective openings sized to receive the latching cusps of the one and second tongues upon assembly, and a central opening sized to receive the central tongue, and wherein the respective openings include side openings for latching with the latching cusps.

2. The air deflector insert of claim 1, wherein the socket extends outwardly and perpendicular to the second one of the longitudinal sides.

3. An air deflector insert component mountable and suspendable downwardly in an opening formed by grid members in a suspended grid ceiling, said component comprising a longitudinal side for deflecting air downwardly and integral means extending along at least a portion of the longitudinal side adapted to at least partially support the side on an adjacent grid member, the side having two ends, attachment means at one end of the longitudinal side and means complementary to the attachment means at the other end of the longitudinal side, at least one of the attachment means and complementary attachment means being perpendicular to the longitudinal side, whereby a plurality of such longitudinal sides can be attached together by hand manipulation to permanently connect the attachment means to the complementary attachment means to form the corners of a polygonal shaped air deflector, and wherein the attachment means and the complementary attachment means are configured to snap together with corresponding like complementary attachment means and like attachment means of respective adjacent components, and wherein the attachment means comprises at least one tongue on a first one of the longitudinal sides, and the complementary attachment means comprises a socket on a second one of the longitudinal side, and wherein the at least one tongue includes a plurality of tongues separated by slots, wherein said plurality of tongues includes said one tongue and a second tongue on opposite sides of a central tongue, said one tongue and said second tongue including latching cusps, and the socket has respective openings sized to receive the latching cusps of the one and second tongues upon assembly, and a central opening sized to receive the central tongue, and wherein the respective openings include side openings for latching with the latching cusps.

4. The air deflector insert component of claim 3, wherein the attachment means comprises a plurality of tongues separated by slots, said plurality of tongues including said at least one tongue that includes a cusp, and the socket has at least one opening within the socket sized to receive the cusp upon assembly.

5. The air deflector insert component of claim 4, wherein the cusp on the tongue passing into the one opening lock together the attachment means and complementary attachment means forming a permanent corner.

6. The air deflector insert component of claim 5, including a plurality of cusps on tongues and a plurality of complementary openings.

7. The air deflector insert component of claim 3, wherein the socket extends outwardly and perpendicular to the longitudinal side and at least one tongue extends parallel to the longitudinal side.

8. A method of assembling a plurality of air deflector insert components to form an air deflector insert mountable in an opening formed by grid members in a suspended grid ceiling, said components having a longitudinal extent and including opposed ends respectively having attachment means and complementary attachment means comprising the steps of: connecting by hand manipulation the attachment means of one component to the complementary attachment means of a second component to form a corner, repeating the connecting step for additional corners until the polygonal shape of the air deflector insert is complete and cannot be disassembled, and positioning the air deflector insert in a ceiling to extend downwardly about an air deflector, wherein at least one of the attachment means and the complementary attachment means include a tongue on the one component and socket on the second component that snap together to join respective components, and wherein the socket extends outwardly and perpendicular to the longitudinal extent of the second component.

* * * * *